United States Patent [19]

Schoultz

[11] 4,242,848

[45] Jan. 6, 1981

[54] METAL STRIP EDGE PROTECTING AND REINFORCING CHANNEL

[76] Inventor: Sven Schoultz, Lidnersgatan 8, S-112 53 Stockholm, Sweden

[21] Appl. No.: 907,749

[22] Filed: May 19, 1978

[30] Foreign Application Priority Data

May 24, 1977 [SE] Sweden ..... 7706076

[51] Int. Cl.[3] ..... E04C 2/38

[52] U.S. Cl. ..... 52/716; 49/462; 52/823; 108/27

[58] Field of Search ..... 49/460, 462, 501, 504; 52/802-805, 821-823, 288, 254-256, 716-718; 248/345.1; 108/27, 51.1

[56] References Cited

U.S. PATENT DOCUMENTS

| | | | |
|---|---|---|---|
| 1,679,117 | 7/1928 | Dye | 248/345.1 |
| 1,803,589 | 5/1931 | Bohnsack | 52/823 X |
| 1,901,869 | 3/1933 | Duffy | 52/716 X |
| 2,295,647 | 9/1942 | Geimer | 52/716 |
| 3,271,919 | 9/1966 | Olton | 52/823 |
| 3,531,855 | 10/1970 | Spring | 108/51.1 |
| 3,591,996 | 7/1971 | Shanok | 52/716 |
| 3,700,385 | 10/1972 | Sherwood | 52/823 |

FOREIGN PATENT DOCUMENTS

| | | | |
|---|---|---|---|
| 191604 | 10/1956 | Austria | 52/823 |
| 575796 | 5/1959 | Canada | 52/716 |
| P 13003 | 11/1956 | Fed. Rep. of Germany | 52/716 |
| 2102953 | 4/1972 | France . | |
| 424137 | 5/1967 | Switzerland . | |
| 1075302 | 7/1967 | United Kingdom | 52/716 |

*Primary Examiner*—J. Karl Bell

*Attorney, Agent, or Firm*—Blanchard, Flynn, Thiel, Boutell & Tanis

[57] ABSTRACT

An edge protecting and reinforcing channel for shelves, boards, and similar plane platelike members. The channel is formed of a single metal strip and as seen in cross section includes an exterior section and two legs perpendicular thereto, and arranged such that with the exterior section extending along an edge of a board, the legs of the channel extend along adjacent portions of the two opposite side surfaces of the board. The free end portions of the legs are formed as inwardly bent edge flaps arranged to be introduced into grooves in the side surfaces of the board. Corner portions joining the exterior section to the legs are bent outwards and thereby form a free space at the inside of such corner portions to loosely cover the corners of the board. The bent flaps at the free edges of the legs of the channel form an acute angle relative to the channel legs.

5 Claims, 1 Drawing Figure

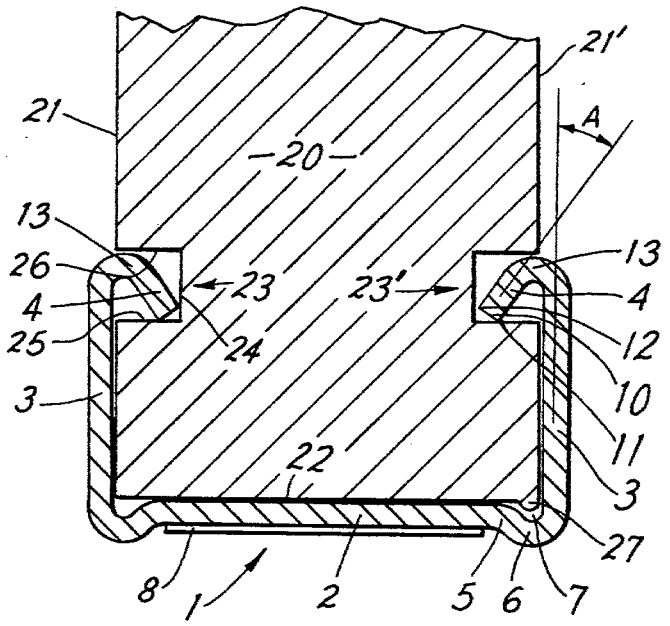
21'
21
A
20
13
26
23
23'
13
4
4
25
24
12
3
10
11
22
3
27
8
1
2
5
6
7

METAL STRIP EDGE PROTECTING AND REINFORCING CHANNEL

BACKGROUND OF THE INVENTION

This invention relates to a frame normally formed out of metal (iron) strip, plastic or other material, made to be fastened on the edges of a platen or other flat surface. This frame serves as protection (or decoration) for the platen against damages in order to prolong the utility of the platen and help the platen to take on more load and/or provide space for the placing of labels describing articles on the shelves.

Existing frames are usually made of metal strips which are normally bent in U-profile with sharp-edges at right angles bent inwards. Thereby the free ends of the sides are bent right inwardly into a narrow slot, which runs parallel along the edges of the platens at predetermined distances on both surfaces. These existing frames have drawbacks. For example when such frames are put on platens as received directly from the manufacturer, whereby the sharp right angles press upon the edges of the corners, then this results in engagement with the corners and leaves free space between the platen side surfaces. Also, when the edges of the platen are deformed during transport, etc., then the U-profile is more difficult to put on the plate. Further, such frames can easily be deformed during delivery and become less reliable. The inward bending lips of the U-profile become loose when not attached with glue, and the sides can easily open up.

This invention has the decided advantage of making a profile or frame which eliminates the above-mentioned defects at a reasonable cost.

BRIEF DESCRIPTION OF THE DRAWING

The invention is explained through the attached drawing indicating the frame on the plate.

DETAILED DESCRIPTION

In the drawing, the frame 1 is made as a channel cross-section with a bottom (or exterior section) 2 and sides (or legs) 3 which are bent inwards at their free upper ends 4 to form angled end flaps thereat. The ends 4 define an angle A with the sides 3. Between the bottom 2 and sides 3 there is a concave part 5 which merges into a convex part 6 and then again into the side 3 which is perpendicular to the bottom 2.

Because of all these bends, the frame, or channel, 1 has a better strength by about 20 to 30% . At the same time, a free space 7 for the plate edges 27 is achieved, which makes it irrelevant if the edges 27 of the plate 20 are damaged or misformed, since the frame 1 still keeps its tight holding function. Because of the rounded edges or corners as described above, a label placed on the bottom 2 is very well protected by the convex parts 6. This is especially good for magnetic labels.

The inner edge 10 of the bent end 4 has a free corner 12, and an inner corner 11 that cuts into the side surface 25 of slot 24 formed in plate 20. The lip or end 4 is sharply bent and thus forms the sharp angle A with the side 3 which is less than 90°. This angle is preferably between 20° and 30°.

The above-described frame works well on a plate like, for example, a bookshelf, which is shown with cross-hatching. The plate 20 as shown in the drawing has two surfaces 21 and 21' as well as a bottom edge 22. At a distance from the edge 22, the plate has two slots 23–23' each defined by a bottom 24, an outer edge 25 and an inner side edge 26.

The frame 1 can be attached to the edge 22 of the plate 20 by sliding it from the side so the bent lips 4 fall into the slots 23–23'. The plate is dimensioned so that the distance between the plate edge 22 and the outer side 25 of the slots 23–23' is slightly bigger than the frame distance between the inner surface of the bottom 2 and the inner edge 11 of the lip 4. In this way the bottom 2 of the frame 1 is pressed tightly against the edge 22 of the plate 20 and is indifferent to normal damages of the plate edges 22 and 27.

The lip 4 easily slides into the slot 23 and causes tight engagement between the bottom 2 and edge 22 which, because of the cooperation of the plate and frame, provides better strength. The inside edge 11 of the bent lip 4 easily penetrates the material of plate 20. This penetrating of edge 11 makes the frame and plate a strong unit. The sides 3 cannot move away from the plate edges or the surfaces 21-21'. Because of the tight fitting of the lip 4 onto the plate 20 no side movements between the bent lips is possible, so that the frame more or less has the strength of a tube.

As is apparent from the above description, the securement of the frame 1 to the plate 20 is independent of the depth of the slots 23–23', that is, the position of the bottom 24 in reference to the outer edges 12 of the bent lips, as well as the position of the inner edge 12 of the slot 26 in reference to the top 13 between the bent lip 4 and the side 3, there can be space between the inner side of the slot and the upper edge of the frame. One doesn't need any particular fitting dimension of the slots 23–23'. The best results are to be achieved, however, when the distance between the inner edge 11 and the top 13 of the bent lip 4 is slightly smaller than the distance between the slot sides 25–26. This is of big advantage when the frame is pressed to the plate from the front side. When pressed onto the plate edge, due to sharp angle A, the sides 3 are pulled apart and then the bent lips 4 can easily be moved or snapped into the slots 23–23'. The only necessary requirement is that the space between edge 22 of the plate 20 and the outer slot edge 25 should be slightly bigger than the dimension between the inner surface of bottom 2 and the inner edge 11 of bent lip 4. The elasticity of the frame permits dimensional variation without doing any harm while yielding the advantages of the invention.

The bend in the bottom 2 and the lips 4 of the frame (especially the concave and convex parts 5 and 6), plus the sharp angle A between sides 3 and lips 4 provides the frame with more strength, so one can use a smaller thickness metal strip to make the frame.

The corner angles of the frame can be other than perpendicular, and one side of the frame can be profiled differently if desired.

What I claim is:

1. In combination, an edge protecting and reinforcing channel and a platelike member, said platelike member having an edge to be protected by said channel and two side surfaces extending from said edge, said side surfaces having grooves therein substantially parallel to said edge, said channel being formed of a single metal strip, said channel as seen in cross section including an exterior section and two legs substantially perpendicular thereto and arranged such that with the exterior section extending along an edge of said platelike member, the legs extend along adjacent portions of the two opposite side surfaces of the platelike member, the free end portions of the legs being formed as inwardly bent edge flaps arranged to be introduced into said grooves in said side surfaces of the platelike member, and including the improvement comprising:

corner portions joining the exterior section to the legs and bent outwards and thereby forming a free space at the inside of each such corner portion to loosely cover the corners of the platelike member;

said bent edge flaps at the free end portions of the legs forming an acute angle relative to the legs, said bent edge flaps each having at the free end thereof an inner corner facing said exterior section, said bent edge flaps each having a top facing away from said exterior section and located at the bend joining said flaps to the respective legs;

said grooves being of substantially rectangular cross section and extending into said side surfaces substantially at a right angle thereto, said grooves each having opposed side walls respectively located nearest and furthest from said edge of said platelike member;

the distance between the edge of said platelike member and the nearest said side wall of said grooves slightly exceeding the distance between said exterior section and said inner corner of said bent edge flap, to press said exterior section of said channel tightly against said edge of said platelike member;

said inner corner of said bent edge flaps tending to cut into the material of said platelike member in said nearest side wall of said groove to resist sideward movement of said legs away from said side surfaces of said platelike member;

the distance between said top of said inwardly bent edge flap and said inner corner thereof being slightly smaller than the distance between the opposed said side walls of each said groove;

whereby after inserting said platelike member edge into said channel, with said inwardly bent edge flaps swung apart due to outward bending of said legs to receive said platelike member, said inwardly bent edge flaps of said channel can easily swing toward each other and enter said grooves.

2. Channel according to claim 1, in which the acute angle is between 20° and 5°.

3. Channel according to claim 1, in which the corner portion joins to said exterior section through a concave portion preferably having a constant bending radius.

4. Channel according to claim 1, in which the corner portion is convex and formed with a constant bending radius/curvature.

5. In combination, an edge protecting and reinforcing channel formed of a single metal strip, said channel as seen in cross section including an exterior section and two legs extending substantially perpendicularly from the edges of said exterior section to form a substantially U-shaped cross section;

a platelike member having an edge to be protected by said channel and two opposite side surfaces terminating in said edge, said exterior section of said channel extending along said edge of said platelike member and having an inner surface opposed thereto, said legs of said channel extending along adjacent portions of said opposite side surfaces of said platelike member;

said opposite side surfaces of said platelike member having grooves therein and extending therealong, the free end portions of said legs of said channel being formed as inwardly bent edge flaps disposed in said grooves of said platelike member, said inwardly bent edge flaps each having at the free end thereof an inner corner facing said inner surface of said exterior section, said inwardly bent edge flaps each having a top facing away from said inner surface of said exterior section and located at the bend joining said flaps to the respective legs;

and wherein the improvement is comprised by said bent edge flaps at the free end portions of said channel legs forming an acute angle relative to said legs, said grooves being substantially rectangular in cross section and extending into said side surfaces substantially at a right angle thereto, said grooves each having opposed side walls respectively located nearest and furthest from said edge of said platelike member, the bent edge flaps of said channel each being spaced from diagonally opposed corners of the groove in said platelike member by triangular cross section free spaces, the distance between the plate- like member edge and the nearest side wall of said grooves slightly exceeding the distance between said inner surface of said exterior section and said inner corner of said bent edge flap, to press said exterior section of said channel tightly against said edge of said platelike member, said inner corner of said bent edge flaps tending to cut into the material of said platelike member in said nearest side wall of said groove to resist sideward movement of said legs away from said opposite side surfaces of said platelike member, the distance between said top of said inwardly bent edge flap and said inner corner thereof being slightly smaller than the distance between the opposed side walls of each said groove;

whereby after inserting said platelike member edge into said channel, with said inwardly bent edge flaps swung apart due to outward bending of said legs to receive said platelike member, said inwardly bent edge flaps of said channel can easily swing toward each other and enter said grooves.

* * * * *